US008224631B2

(12) United States Patent
Stankus et al.

(10) Patent No.: US 8,224,631 B2
(45) Date of Patent: Jul. 17, 2012

(54) STRESS, GEOLOGIC, AND SUPPORT ANALYSIS METHODOLOGY FOR UNDERGROUND OPENINGS

(75) Inventors: John C. Stankus, Canonsburg, PA (US); Jinrong Ma, Cheswick, PA (US); Hanjie Chen, Pittsburgh, PA (US); Xiaoting Li, Cheswick, PA (US)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 448 days.

(21) Appl. No.: 12/543,220

(22) Filed: Aug. 18, 2009

(65) Prior Publication Data

US 2010/0042381 A1 Feb. 18, 2010

Related U.S. Application Data

(60) Provisional application No. 61/089,766, filed on Aug. 18, 2008.

(51) Int. Cl.
*G06G 7/48* (2006.01)

(52) U.S. Cl. ..... 703/6; 73/786; 405/288; 405/259.1

(58) Field of Classification Search ..... 703/1, 6; 73/786; 405/288, 259.1; 148/196
See application file for complete search history.

(56) References Cited

U.S. PATENT DOCUMENTS

| | | | | |
|---|---|---|---|---|
| 4,707,898 | A * | 11/1987 | Creech | 148/196 |
| 5,415,498 | A * | 5/1995 | Seegmiller | 405/288 |
| 5,433,558 | A * | 7/1995 | Gray | 405/259.1 |
| 5,542,788 | A * | 8/1996 | Stankus et al. | 405/288 |
| 5,824,912 | A * | 10/1998 | Stankus et al. | 73/786 |
| 6,757,642 | B1 * | 6/2004 | Boudreau et al. | 703/1 |
| 6,832,165 | B2 | 12/2004 | Stankus et al. | |
| 2004/0240948 | A1 * | 12/2004 | Harbaugh et al. | 405/288 |
| 2005/0031420 | A1 * | 2/2005 | Domanski et al. | 405/288 |

* cited by examiner

*Primary Examiner* — Kandasamy Thangavelu
(74) *Attorney, Agent, or Firm* — The Webb Law Firm

(57) ABSTRACT

A method of designing supports for an underground mine opening comprising the steps of: receiving mine slope information including at least one of site location, entry length, entry grade, entry orientation, size of opening, surface topology, adjacent borehole data and rock mechanics test data, historical roof fall height, and expected steel set support capacity; conducting stress and geological condition evaluation of the mine opening using a finite element computer modeling program based on the mine opening information; and designing structural supports for the mine opening utilizing the stress and geological condition evaluation of the mine opening.

8 Claims, 15 Drawing Sheets

| Rock type | Density, pcf | E, psi | Poisson ratio, μ | UCS, psi | Tensile, psi | Shear, psi | Tri-axial, psi |
|---|---|---|---|---|---|---|---|
| Sandstone | 158 | 1,850,000 | 0.17 | 9,861 | 769 | 3,055 | 35,270 |
| Sandy shale | 167 | 4,490,000 | 0.31 | 13,370 | 1,570 | 3,550 | |
| Shale | 165 | 3,210,000 | 0.36 | 11,257 | 1,381 | | 27,245 |
| Clay shale | 167 | 3,770,000 | 0.37 | 11,716 | 969 | | |
| Freeport coal | 84 | 500,000 | 0.42 | 3,450 | 242 | | 8,657 |
| Claystone | 162 | 350,000 | 0.58 | 5,842 | 1,305 | | 26,149 |

FIG. 4A

| Strata name | Density pcf | E(Psi) | μ | φ, deg | C, psi |
|---|---|---|---|---|---|
| Refuse & soil | 100 | 11,600 | 0.4 | 20 | 32 |
| Strong limestone | 160 | 4,500,000 | 0.2 | 40 | 1,250 |
| Weak claystone | 150 | 350,000 | 0.35 | 23 | 82 |
| Weak shale | 150 | 1,500,000 | 0.3 | 25 | 350 |
| SS-siltshale Interbed | 160 | 2,100,000 | 0.28 | 35 | 547 |
| Shale | 155 | 2,100,000 | 0.28 | 33 | 407 |
| SS with shale streaks | 160 | 3,000,000 | 0.22 | 34 | 930 |
| Weak limestone | 155 | 2,400,000 | 0.22 | 35 | 651 |
| Siltstone | 155 | 2,200,000 | 0.26 | 35 | 508 |
| Shale-siltshale with SS streaks | 158 | 2,500,000 | 0.24 | 35 | 573 |
| Coal | 80 | 800,000 | 0.42 | 30 | 260 |
| Claystone-siltstone-clayshale | 150 | 1,600,000 | 0.32 | 24 | 422 |
| Shale-siltshale | 155 | 2,400,000 | 0.23 | 34 | 545 |
| Shale-siltstone | 158 | 3,200,000 | 0.23 | 34 | 1,196 |
| Claystone-clayshale-SS streaks | 158 | 1,700,000 | 0.32 | 25 | 398 |
| Claystone-clayshale | 156 | 1,650,000 | 0.33 | 26 | 375 |
| Claystone | 150 | 1,200,000 | 0.3 | 25 | 303 |
| Clayshale | 155 | 1,800,000 | 0.28 | 30 | 303 |
| Weak clayshale | 155 | 1,250,000 | 0.31 | 26 | 306 |
| Shale-claystone | 155 | 1,500,000 | 0.35 | 28 | 330 |
| Siltshale | 160 | 2,500,000 | 0.22 | 35 | 833 |
| Clayshale-siltshale-SS | 158 | 2,500,000 | 0.25 | 34 | 585 |

FIG. 4B

STRESS, GEOLOGIC, AND SUPPORT ANALYSIS METHODOLOGY FOR UNDERGROUND OPENINGS

CROSS-REFERENCE TO RELATED APPLICATION

This application claims the benefit of U.S. Provisional Application No. 61/089,766, filed Aug. 18, 2008, the entire contents of which is hereby incorporated by reference.

BACKGROUND OF THE INVENTION

1. Field of the Invention

The present invention relates to underground mining and, more particularly, to the design of supports for roof control at underground openings.

2. Description of Related Art

In the mining industry, steel set are generally installed at underground openings such as slope, belt entry, or caved area which require a reliable and long-term support for the roof to protect mine personnel and equipment. However, there are currently no steel set design guidelines and methodologies available that have been well-established to meet engineering needs in the underground mining industry. Historically, steel set designs were based on trial-and-error and field experiences. The majority of steel sets or supports installed typically perform well due to the over-design and excessive safety factor purposely adopted by engineers, which result in unnecessary financial investment and a waste of steel and other resources. On the other hand, less conservative steel set design may provide a structure that cannot provide adequate roof support, which can result in unexpected roof falls causing personnel injuries, equipment damages, and economic loss due to extended production down time.

Further, other design practices adopt a steel structure design method in civil engineering to design steel set. However, such practices generally over-simplify steel set design and ignore the effect of ground pressure variation caused by changing geological conditions in the vicinity of an opening. Therefore, a practical and reliable steel set design methodology is needed which takes into account the effect of geological conditions; identifies technically and economically optimal steel set per field condition and engineering needs; designs the most reliable steel set structure; and can verify the adequacy of the developed steel set.

U.S. Pat. No. 6,832,165 to Stankus et al. is generally directed to a method for predicting potential mine roof failures including the steps of identifying relevant factors that affect mine roof stability; quantifying and weighing each relevant factor; and calculating a roof instability rating (RIR) value based upon the quantified relevant factors.

U.S. Pat. No. 5,824,912 to Stankus et al. is generally directed to a method for designing roof control in an underground mine including the steps of obtaining mechanical properties of the mine site, applying the mechanical properties to a layout of a mine in the mine site, and determining from the application of the mechanical properties, stresses in the mine site.

SUMMARY OF THE INVENTION

In one embodiment, the present invention is a method of designing supports for an underground mine opening comprising the steps of: receiving mine slope information including at least one of site location, entry length, entry grade, entry orientation, size of opening, surface topology, adjacent borehole data and rock mechanics test data, historical roof fall height, and expected steel set support capacity; conducting stress and geological condition evaluation of the mine opening using a finite element computer modeling program based on the mine opening information; and designing structural supports for the mine opening utilizing the stress and geological condition evaluation of the mine opening. The method may further includes the steps of verifying the adequacy of the structural support design following AISC national standards and validating the structural support design using a finite element computer modeling program. Further, the designing of the structural supports for the mine opening further utilizes at least one of primary roof bolting plan, current industrial practice, expected support capacity, size of the opening, and American Institute of Steel Construction (AISC) national standards.

Further, the method may include the steps of determining a Strata Weakness Indication Factor (SWIF); identifying potential weak zones of rock strata along the mine opening using the SWIF; and modifying the design of the structural supports based on the potential weak zones of the rock strata. The SWIF is defined as the ratio of in-situ original distortional energy scalar of rock before excavation to the distortional energy scalar after excavation under overburden and geological conditions. A comparatively larger SWIF indicates the potential weak zone of the rock strata.

In another embodiment, the method includes the steps of determining a Roof Stability Factor (RSF); identifying potentially unstable sections of rock strata along the mine opening; and modifying the design of the structural supports based on the potentially unstable sections of the rock strata. The RSF is defined as the ratio of shear strength generated by normal confinement, cohesion, and angle of internal friction, to actual maximum shear stress at a mid-span of the mine opening immediate roof. A comparatively lower RSF indicates the potentially unstable section of the roof strata In a further embodiment, the method includes the steps of determining a Tensile Safety Factor (TSF), identifying potentially unstable sections of rock strata along the mine opening using the TSF, and modifying the design of the structural supports based on the potentially unstable section of the rock strata. The TSF is defined as a ratio of tensile strength of rock strata to horizontal stress at a specified location. A comparatively lower TSF indicates the potentially unstable sections of the rock strata.

In yet another embodiment, the present invention is a system for designing supports for an underground mine opening, the system comprising a computer having a computer readable medium having stored thereon instructions which, when executed by a processor of the computer, causes the processor to perform the steps of: receiving mine opening information including at least one of site location, entry length, entry grade, entry orientation, size of opening, surface topology, adjacent borehole data and rock mechanics test data, historical roof fall height, and expected steel set support capacity; and conducting stress and geological condition evaluation of the mine opening using a finite element computer modeling program based on the mine opening information. The instructions may further cause the processor to perform the step of selecting a structural support design for the mine opening utilizing the stress and geological condition evaluation of the mine opening and known support capacity of structural support designs. Further, the instructions may also cause the process to perform the steps of verifying the adequacy of the structural support design following AISC national standards and validating the structural support design using a finite element computer modeling program.

In yet a further embodiment, the present invention is a computer readable medium having stored thereon instructions which, when executed by a process, causes the processor to: receive mine opening information including at least one of site location, entry length, entry grade, entry orientation, size of opening, surface topology, adjacent borehole data and rock mechanics test data, historical roof fall height, and expected steel set support capacity; and conduct stress and geological condition evaluation of the mine opening using a finite element computer modeling program based on the mine opening information.

BRIEF DESCRIPTION OF THE DRAWINGS

FIG. 4A shows a table of engineering properties of intact rock;

FIG. 4B shows a table of engineering properties of rock-mass;

DESCRIPTION OF THE PREFERRED EMBODIMENTS

Figure 1A:
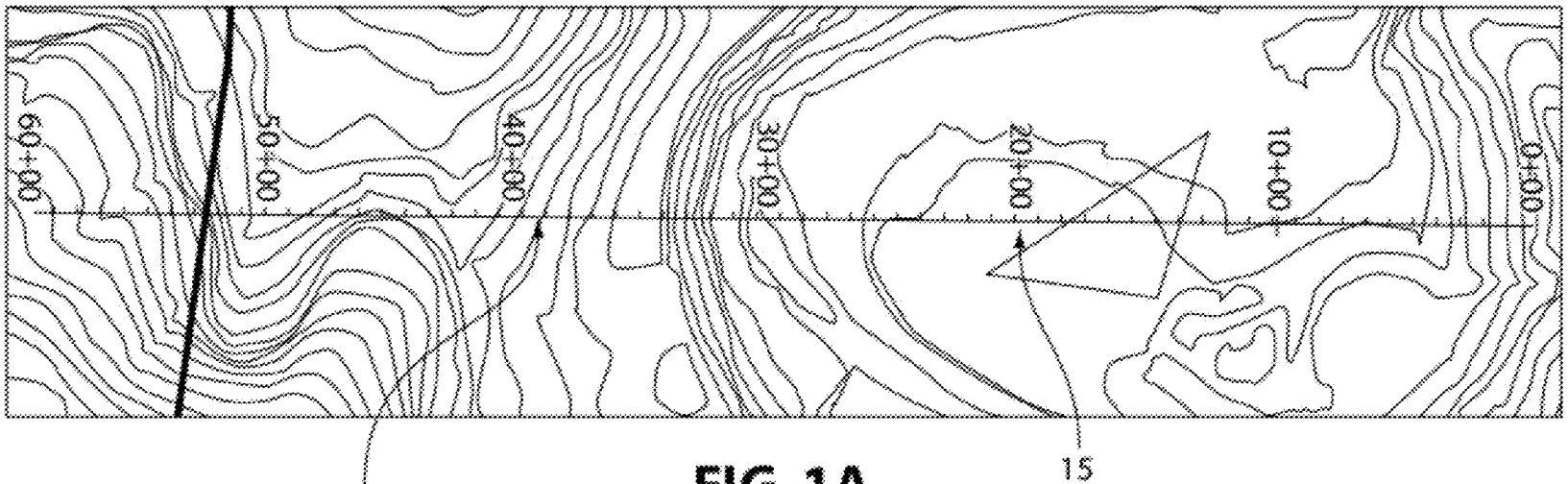
FIG. 1A shows a pan view of a proposed mine slope according to one embodiment of the present invention.

For the purposes of the description hereinafter, it is to be understood that the invention may assume various alternative variation step sequences, except where expressly specified to the contrary. It is also to be understood that the specific information illustrated in the attached drawings and described in the following specification are simply exemplary embodiments of the invention.

In the embodiments of the present invention described below, a method of designing supports for a mine opening, such as a mine slope, generally includes the step of obtaining information and geological conditions of the mine opening, and determining stress and geological conditions of the mine opening using a finite element analysis (FEA) computer modeling program based on the information and geological conditions of the mine opening. The method further includes the step of designing steel set structural supports for the mine opening based on the stress and geological conditions of the mine opening, current industrial practice, expected support capacity, size of the opening, structural analyses, and a national standard of the American Institute of Steel Construction (AISC). The method may further include verifying the adequacy of the steel set design following the AISC standards and validating the design of the structural supports using finite element computer modeling.

Information and geological conditions of the mine slope may include experiences and data obtained from adjacent mines, known geological information of the site location, the slope length, grade, orientation, and size of the opening. Additional information obtained for the mine slope may include surface topology of the area, adjacent borehole data, rock mechanics test data, and geological structural maps of the mine slope area. Further information collected from the mine may also include historical roof fall data, primary roof bolting plan to be used, and the way that the steel set will be installed, such as, whether the voids between rock wall and the steel set will be backfilled, whether support legs will be fixed on the floor, etc.

The method of the present invention may also include the step of obtaining certain design expectations of the owner or operator of the proposed mine slope. The design expectations may include minimum width and height of the slope opening, allowable mid-point roof deflection, height of dead rock to be supported, and type of steel set (square set, long-radius arc, double radius arch, or semi-circular arch) preferred.

In certain embodiments, an initial steel set design for the mine slope may be selected based on structural analyses, the stress condition, and the national AISC standard with the consideration of geological conditions of the mine slope, current industrial practice, expected support capacity, size of the opening, and customer requirements. The structural analyses may include, for instance, determining the maximum load capacity for a particular steel set based on standard engineering principles. Thus, the support or load capacity of certain structural supports may be known through prior use of the design or by calculating the support capacity of the particular design.

The adequacy of the design of the structural supports is then verified by following the AISC standards for structural steel design. Although the supports for the mine slope discussed hereinbelow are embodied as arch set or square set, other suitable supports may be utilized, such as long radius arch, double radius arch sets, or other frame-like structures. The design criterion based on the AISC standards includes: a sufficient moment connection between the leg and beam or arc of the support; no material yielding, such as flexural, tensile, compressive, and shear failure; no lateral torsional buckling to the flange and web of the support; and no structural buckling of the support legs. In accordance with AISC standards, an analysis of a cross-member in an arch set includes: checking max deflection; checking compactness of the cross-member; checking flexural strength, i.e., no localized buckling of the flange and web; and checking the shear strength. The analysis of the leg includes: checking the column effect or structural buckling; checking the beam effect, i.e., the compactness, flexural strength, and unity as a beam-column member, i.e., combination effect of flexure and compression. If the selected steel set design did not meet the AISC standards, an alternative steel set would then have to designed and verified as discussed hereinabove.

In certain embodiments, after verifying the design following the AISC national standards, a detailed structure design analysis is conducted to determine type of moment connection between legs and cross-members, structure bolts (size, type, and number), size of plates, size of welds, and size of gusset. For example, in a square set design having a cross-member and legs, a steel plate may be welded to the top of each leg. A portion of the steel plate may extend towards the slope opening and may be supported by a triangular-shaped gusset. Further, brace plates may be welded to the web and top and bottom flanges of a W-section cross-member at critical stress concentration locations to eliminate localized flange buckling and web failure. The gusset may reduce the size and number of bolts and size of fillet weld, increase flexural strength of the cross-member, and improve lateral stability and torsional strength of the cross-member when a lateral or eccentric load occurs on the cross-member. The bolting design is generally a function of the bending moment, number of bolts, and bolt location.

The design of the steel set for the mine slope is validated using an FEA computer modeling program based on the mechanical properties of the steel components (W section, plate steel, bolts, welds, etc.) and a predetermined uniform or localized loads on the support based on the information obtained in the previous steps. The validations using the FEA model may include the determination of maximum principle stress, minimum principle stress, maximum shear stress value, maximum shear strain, deformation of the steel support, and safety factor based on suitable ductile material failure criterion. Assuming an extreme loading condition, if the full-size three-dimensional finite element computer model demonstrates that the cross-member of the steel set has unacceptable vertical deflection or material yielding within the structure, the steel set analysis procedure will then reiterate to identify an alternative steel set design. The optimal design will be developed and verified according to the AISC standards, and validated using the finite element computer model as discussed hereinabove.

EXAMPLE 1

Figure 1B:
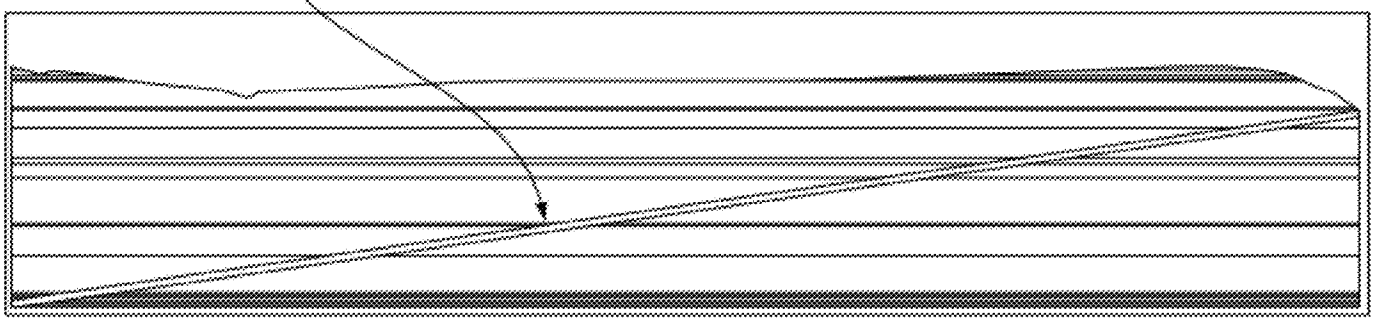
FIG. 1B shows a profile view the proposed mine slope shown in FIG. 1A.
Figure 2A:
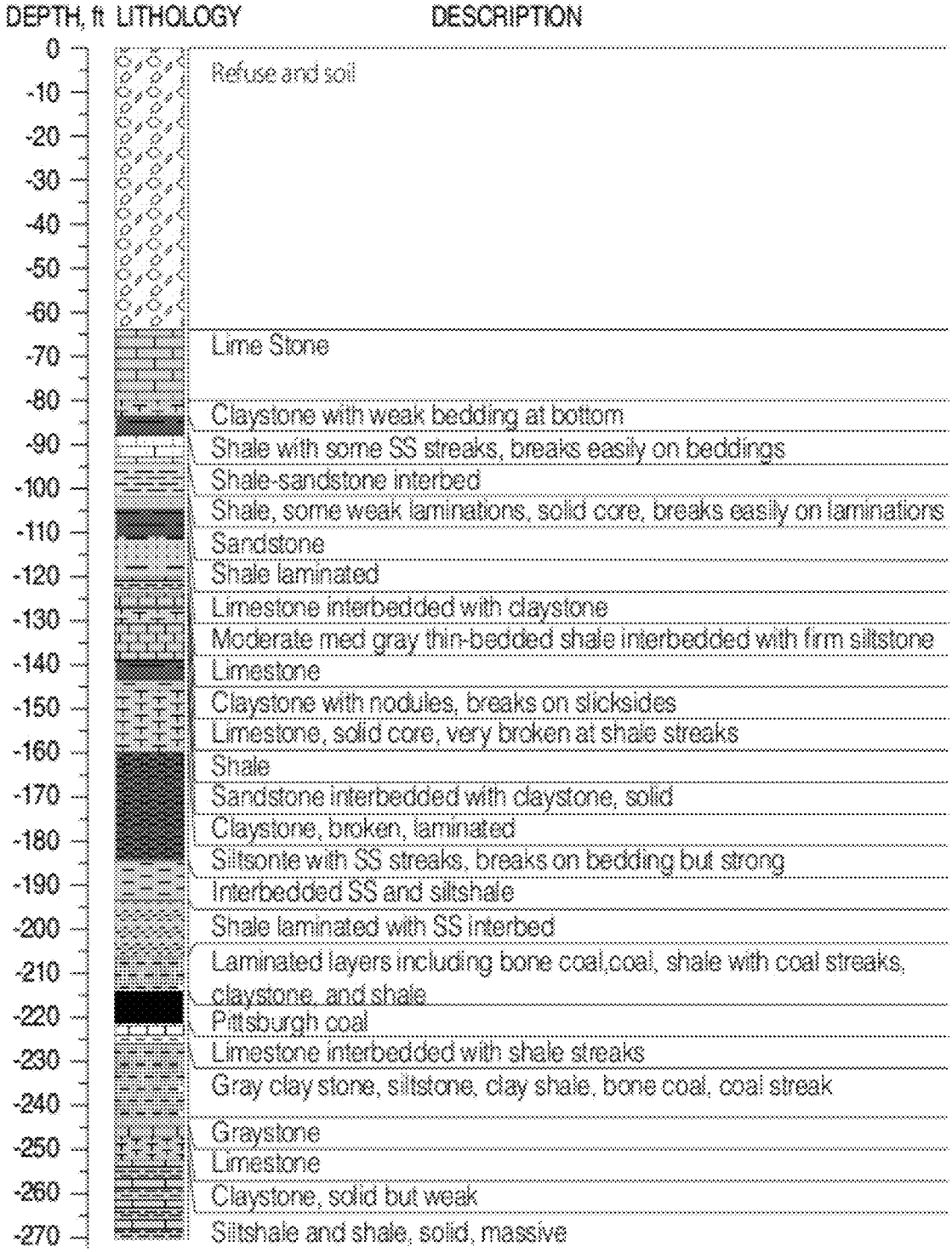
FIG. 2A is a lithological log of a borehole adjacent to the slope in FIG. 1A.
Figure 2B:
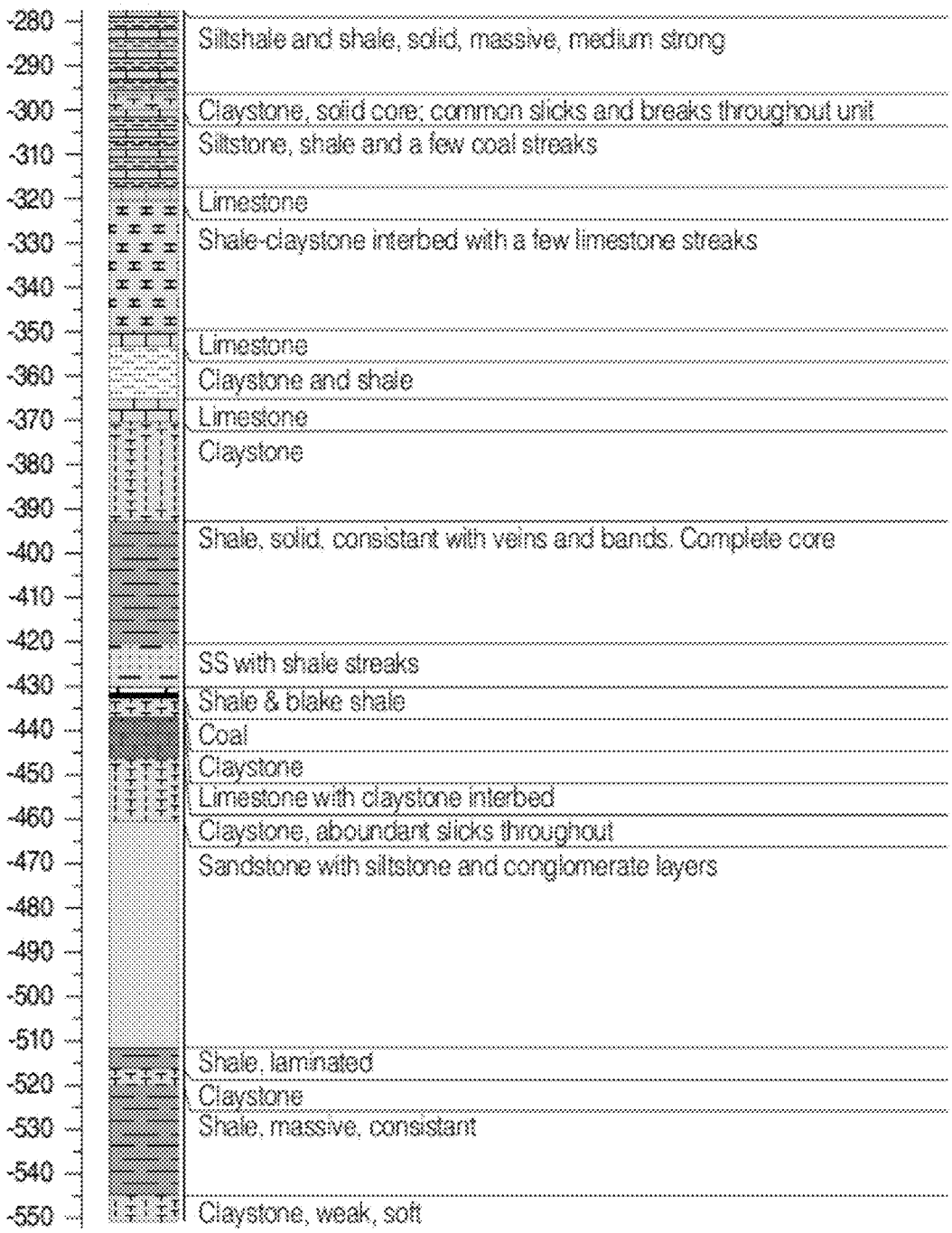
FIG. 2B is a continuation of the lithological log shown in FIG. 2A.
Figure 2C:
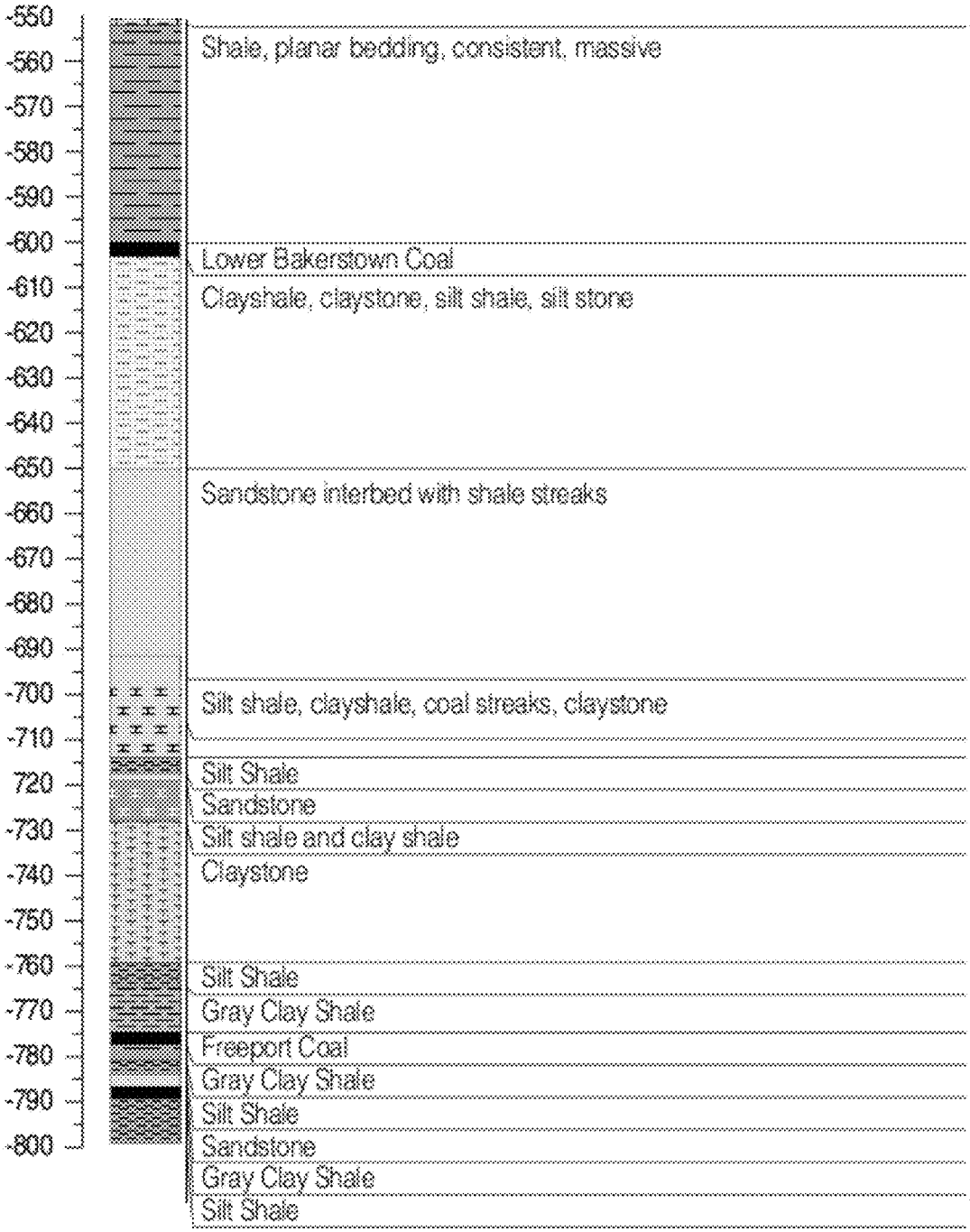
FIG. 2C is a continuation of the lithological log shown in FIG. 2B.
Figure 3:
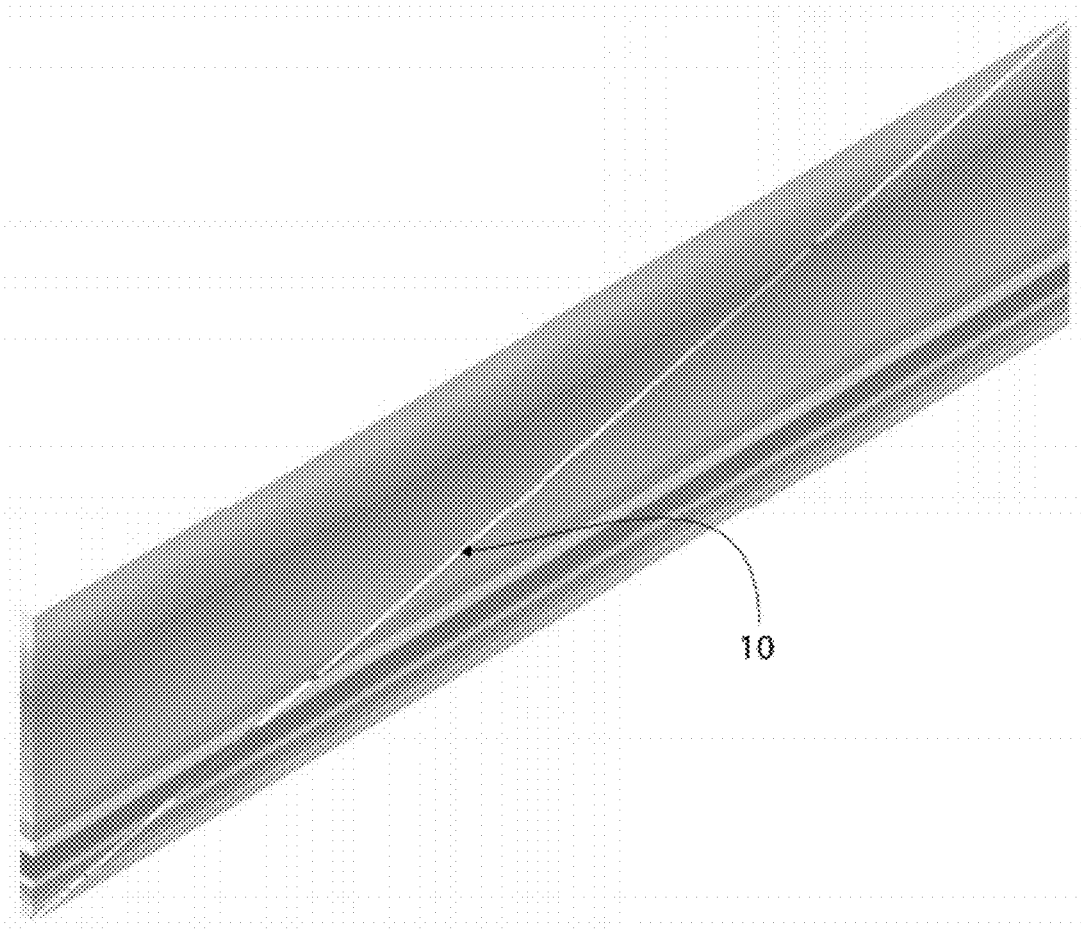
FIG. 3 is a perspective view of a three-dimensional finite element computer model of the slope in FIG. 1A.

As shown in FIGS. 1A and 1B, a proposed mine slope 10 to extract coal from a particular coal seam extends a total length of approximately 3,215 ft at grade of 24.9% (14°). The proposed mine slope 10 is located in a mountainous region at a depth of cover ranging from 800-1200 ft. The proposed mine slope 10 has a slope opening of 18 ft wide by 18 ft high. Geotechnical information for the proposed mine slope 10 was primarily obtained from a nearby borehole 15. Based on the nearby borehole 15, it can be determined that, even though some minor lithological units thin out or vary, the primary lithological units such as the coal, limestone, and sandstone are fairly consistent in terms of thickness, elevation, and rock type. Therefore, it is assumed that the overburden strata are flat with consistent thicknesses. As indicated above, the thickness and lithology of the strata are primarily derived from borehole 15, which is close to the slope portal area and is considered typical from a strata lithology perspective. The borehole location is shown in FIG. 1A. As shown by the borehole logs (FIGS. 2A-2C), the overburden strata that will be encountered are dominated by limestone, siltshale, shale, claystone, clayshale, sandstone, and coal seams To identify strong and weak sections along the slope and to enable appropriate roof support design, FEA computer modeling of the stress distribution in the surrounding strata is conducted. The vertical displacement and stress at the middle of the immediate roof of the 18 ft wide×18 ft high slope, is analyzed based on the computer modeling results. A full-size three-dimensional model, as shown in FIG. 3, is then developed. With a total length of 3,210 ft and a total height of 800 ft, the model includes overburden strata from the surface to the immediate floor strata below the coal seam. To minimize the boundary effect and to realistically model the stress redistribution and roof displacement after slope excavation, a 36 ft (twice the width) wide zone of solid strata is incorporated on both sides of the slope in the model. Since the model is symmetric with respect to the middle vertical plane of the slope, a symmetric model is utilized to reduce the total number of elements and computation time. The symmetric model includes half of the opening (9 ft) and a 36 ft thick solid rock strata on one side of the opening. To model the state of stress and strain of the overburden strata, the elements at the bottom of the model are restrained in the vertical direction. The elements at the four vertical sides are assigned zero lateral displacement. Standard gravitational load was assigned on the model based on the generic material density of each stratum. No other external load was considered. In this particular example, average rock mechanics test results of intact rock specimens, as shown in FIG. 4A, were available and utilized in the analysis. Considering the fact that rockmass will be dramatically weaker than intact rock due to the presence of fractures, joints, and weak bedding planes, the engineering properties of the rockmass, as shown in FIG. 4B, were derived from actual rock mechanics data (limited and only for major lithological units) and properties from published rock mechanics literature. Furthermore, for this particular example, a linear, static numerical simulation was conducted.

Figure 5:
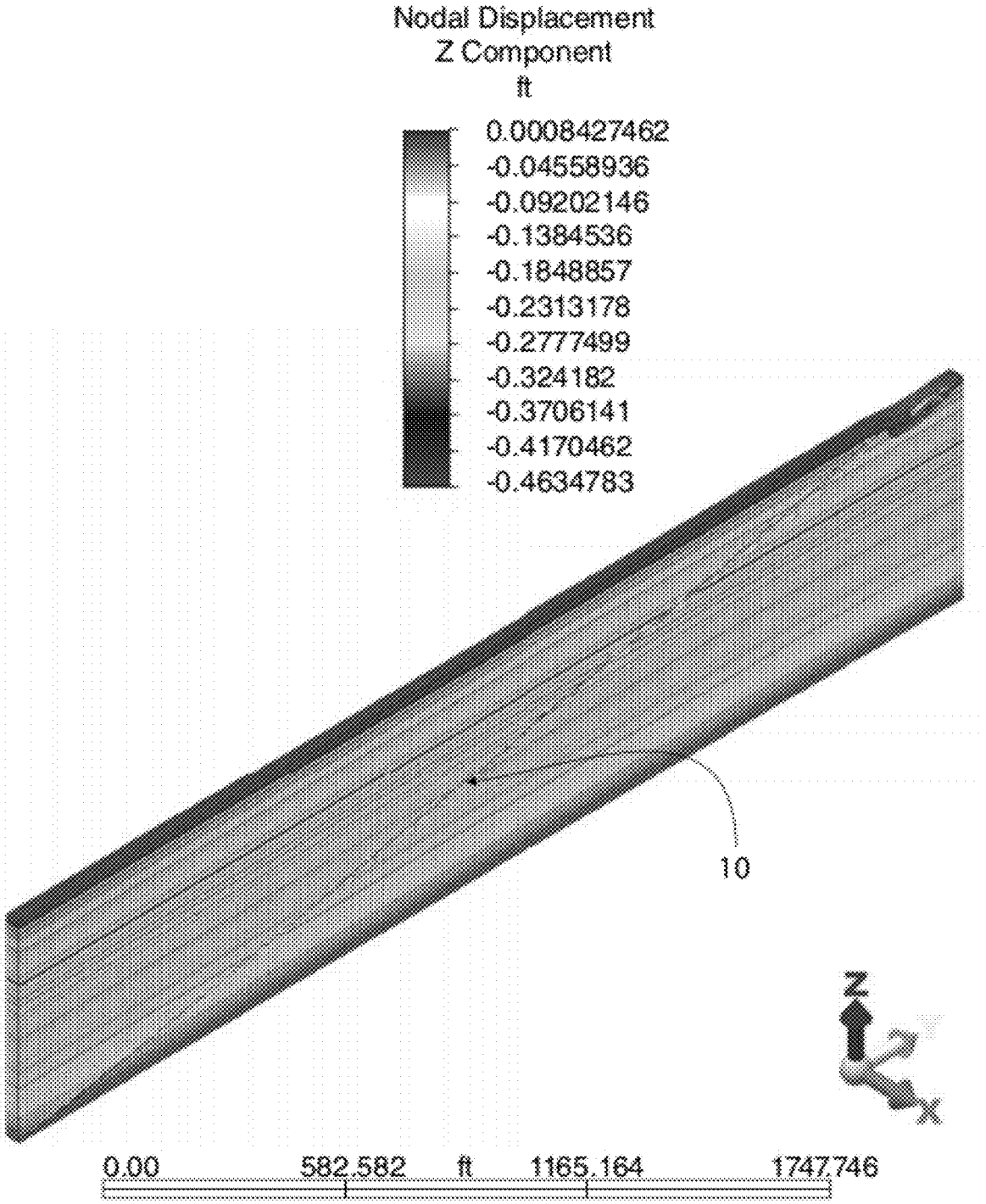
FIG. 5 is a perspective view of a three-dimensional finite element computer model showing vertical displacement at a mid-point of the roof of the slope in FIG. 1A.
Figure 8:
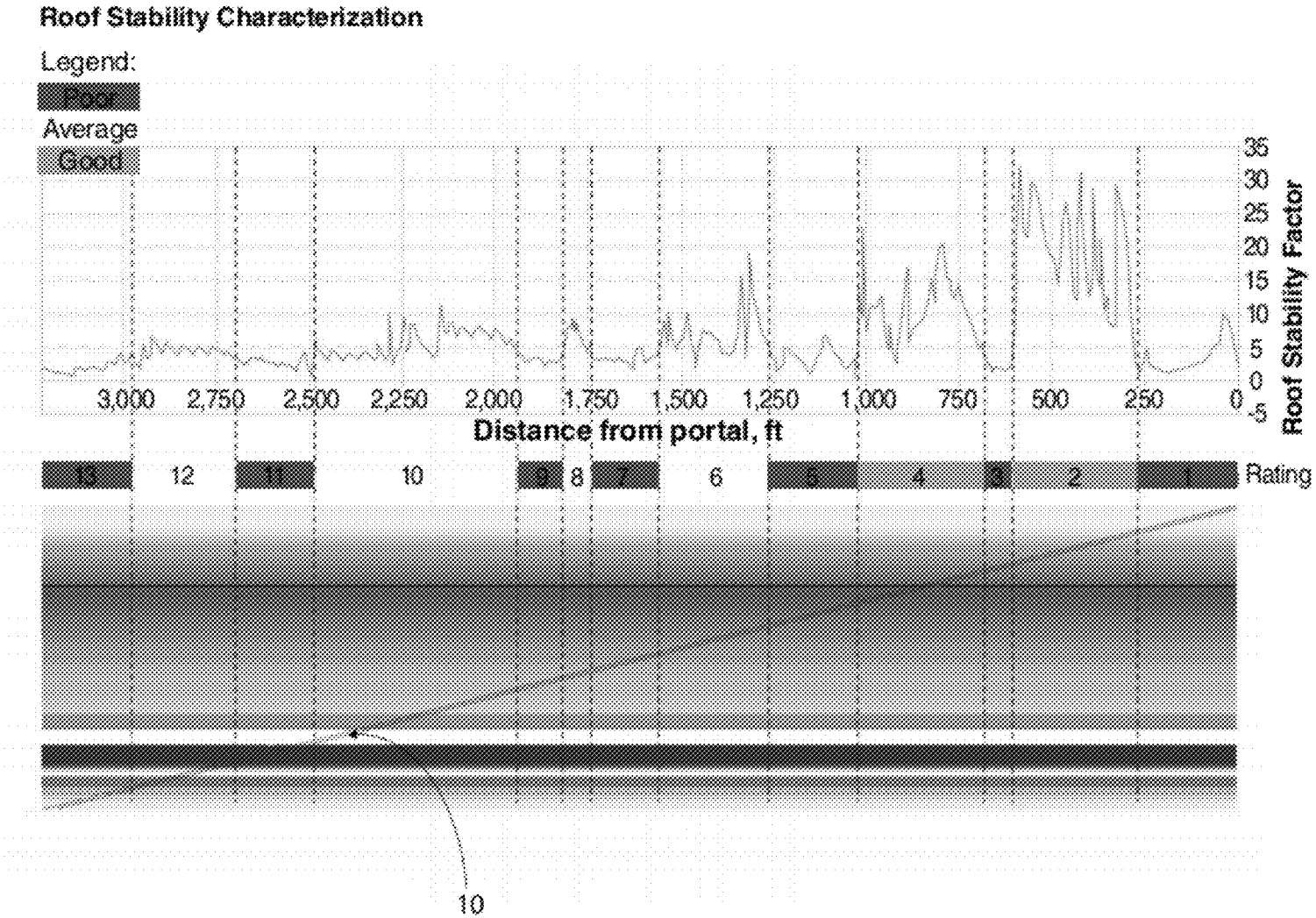
FIG. 8 is a graph of roof stability rating at the mid-point of immediate roof along the slope in FIG. 1A.

The strata displacement surrounding the slope is shown in FIG. 5. Considering that the midpoint of the 18 ft wide roof span has the largest roof sag after excavation, the vertical displacements of all midpoint nodes at the immediate roof are extracted from the model output data. Possible vertical sag after rock extraction at the roof midpoint with respect to the distance from the portal is shown in FIG. 8. These values represent mid-span roof sag after rock excavation. The immediate slope roof has a maximum vertical displacement of approximately 1.31 inches at a horizontal distance of 210 ft from the portal.

Figure 6A:
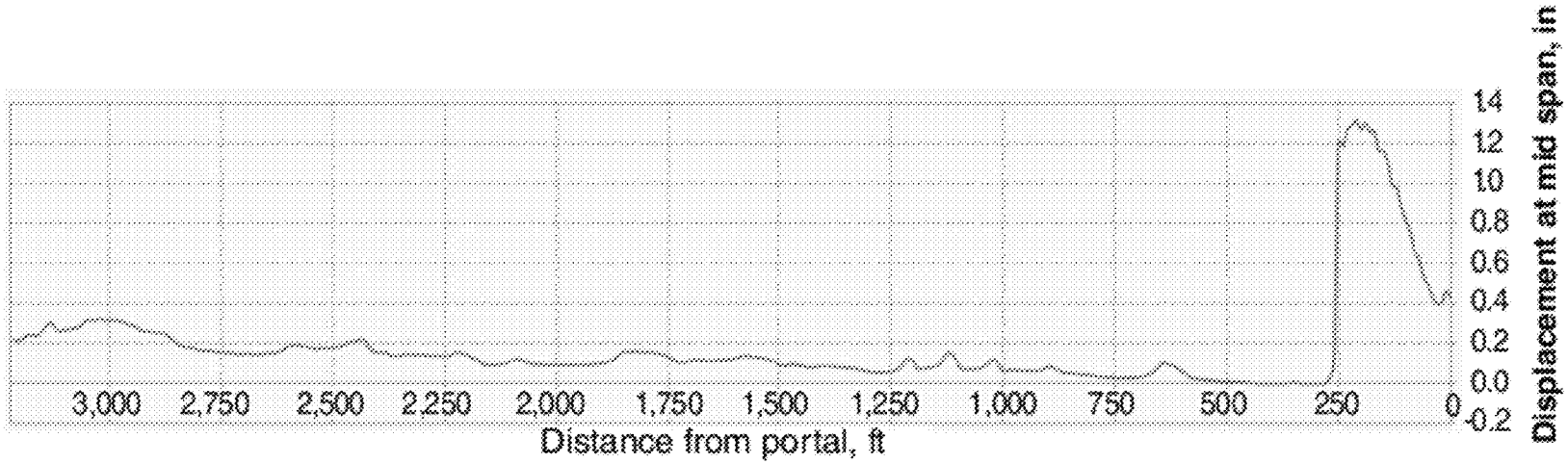
FIG. 6A is a graph of vertical immediate roof displacement with respect to the distance from the portal of the slope in FIG. 1A.
Figure 6B:
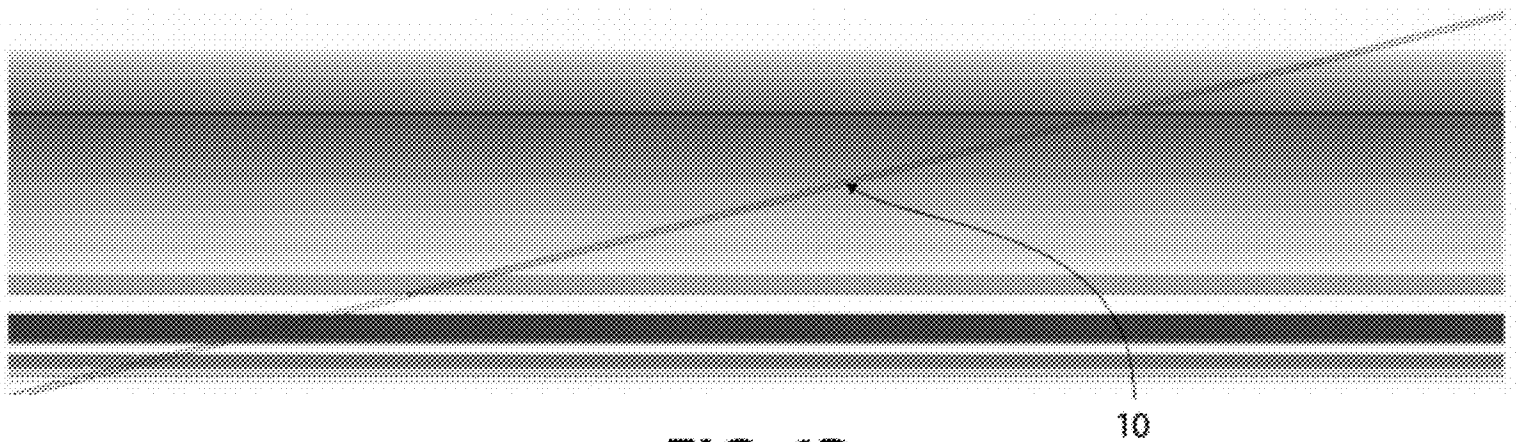
FIG. 6B is a profile view the mine slope corresponding to the graph shown in FIG. 6A.
Figure 7:
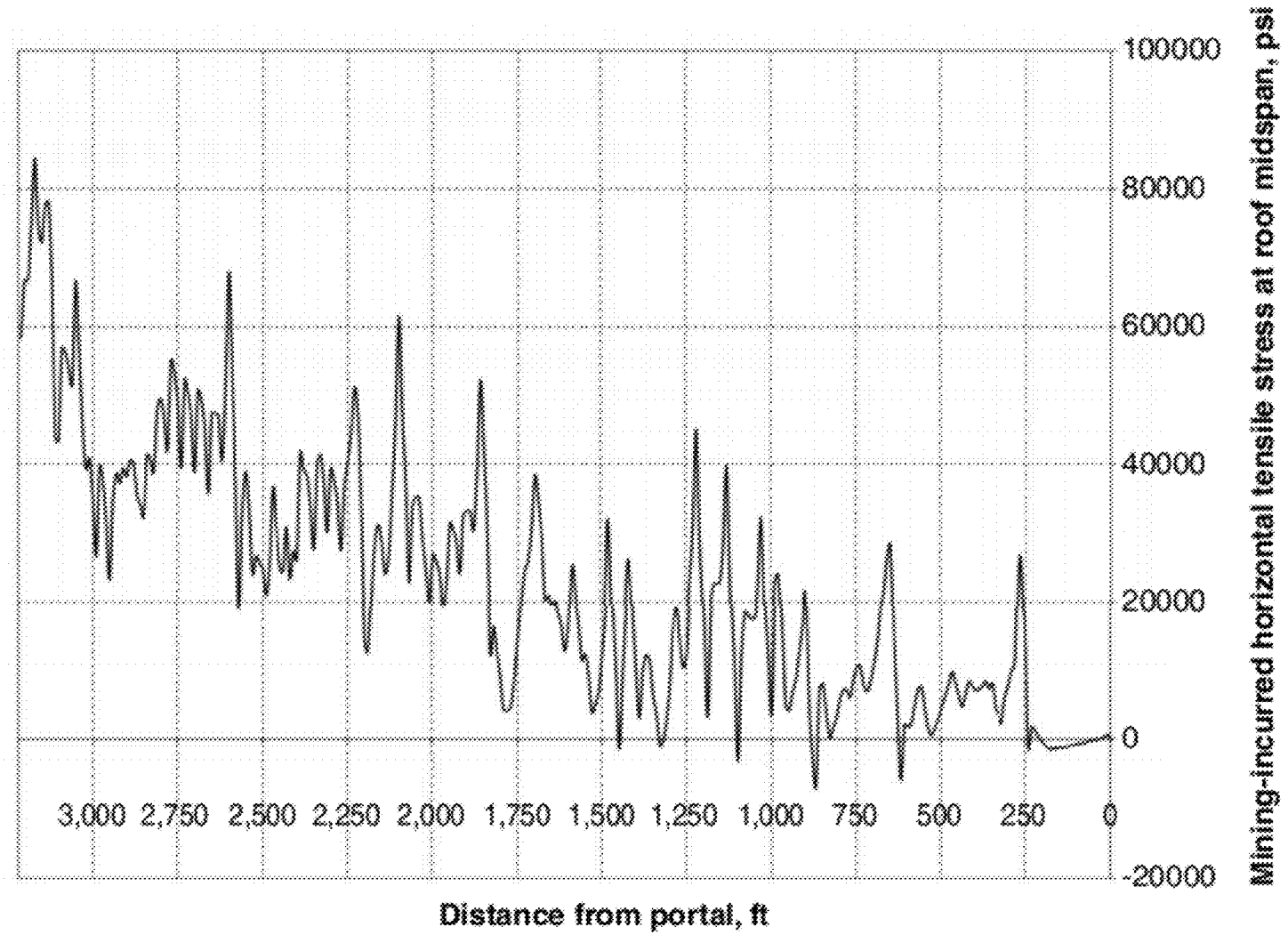
FIG. 7 is a graph of variation of mining-incurred horizontal stresses at mid-span of immediate roof along the slope shown in FIG. 1A.

As shown in FIGS. 6A and 6B, roof sag increases dramatically at the collar section (0-250 ft from portal) with increasing cover. This result is considered normal because the material surrounding the slope opening is primarily soft and weak refuse and soil. From a ground control perspective, the arch effect within the shallow cover above the opening is less apparent due to low horizontal confinement. Since the shallow overburden material does not provide an apparent self-supporting effect, the opening at the shallow cover portion will be subjected to high dead gravitational load. This condition causes relatively high vertical roof displacement. In general, roof sag gradually increases from 0.1 inch to 0.3 inch with the increased cover at the intermediate section of the slope. Roof sag varies with the change of rock lithology. Slope sections with limestone, siltstone, sandstone, and sandy shale immediate roof generally have less vertical roof mid-span displacement than those with claystone, clayshale, coal, or laminated roof. The possible horizontal stress at the immediate roof midpoint was also analyzed. The variation of horizontal stress values of all the midpoint nodes of immediate slope roof before and after rock excavation with respect to the distance from the portal is shown in FIG. 7.

Furthermore, possible unstable slope areas may also be identified. Failure of rock material is generally described by Mohr-Coulomb strength criterion, which assumes that a shear failure plane develops in the rock mass if the shear strength $\tau$ generated by normal confinement $\sigma_n$, cohesion c, and angle of internal friction $\phi$ cannot resist the actual maximum shear stress $\tau_{max}$. When failure occurs, the stresses developed on the failure plane are located on the strength envelope. Mohr-Coulomb strength criterion assumes that rock material enters failure state when the following equation is satisfied:

$$\tau = c + \sigma_n \tan\varphi \quad \text{(Equation 1)}$$

$$\sigma_n = \frac{1}{2}(\sigma_1 + \sigma_3) + \frac{1}{2}(\sigma_1 - \sigma_3)\cos(2\theta) \quad \text{(Equation 2)}$$

$$\tau = \frac{1}{2}(\sigma_1 - \sigma_3)\sin(2\theta) \quad \text{(Equation 3)}$$

$\sigma_1$ is the maximum principle stress;
$\sigma_3$ is the minimum principle stress;
c is the cohesion;
$\phi$ is angle of internal friction;
$\theta$ is angle of failure plan, $\theta = \frac{1}{4}\pi + \frac{1}{2}\phi$ With the numerical modeling results, $\sigma_1$ and $\sigma_3$, and rock mechanics data, the failure state of each node can be determined by comparing the value on the left side and right side of Equation 1. If value of $\tau$ is greater than that of $c + \sigma_m \tan\phi$, the rock material can be assumed to be in a failure mode. Otherwise, it can be considered stable. For comparison, a Roof Stability Factor (RSF) is defined as:

$$RSF = \frac{C + \left[\frac{1}{2}(\sigma_1 + \sigma_3) + \frac{1}{2}(\sigma_1 - \sigma_3)\cos(2\theta)\right]\sigma_n \tan\phi}{\frac{1}{2}(\sigma_1 - \sigma_3)\sin(2\theta) * 1.5} \quad \text{(Equation 4)}$$

It should be noted that a safety factor of 1.5 is built into Equation 4. Therefore, it is assumed that rock materials will likely enter a failure state if its RSF is less than 1.

With the methodology described above, the RSF of the midpoint of immediate slope roof is calculated. FIG. 8 shows the variation of RSF with respect to distance from portal. Based on numerical modeling results and RSF, the slope can be divided into thirteen (13) sections. The total slope was categorized into three types based on roof stability characterization. Sections 1, 3, 5, 7, 9, 11, and 13 have relatively lower roof stability factors, and may have roof control problems. This conclusion is consistent with the lithology of roof strata at each identified weak section. At these areas, the roof strata is moderate to soft, fractured, thin-bedded, gray shale, fractured claystone, layered silt shale, or layers mixed with coal/clay streaks. These types of immediate roof are typically weak and de-laminate easily after rock removal. Sections 6, 8, 10, and 12 have average roof stability factors, and, thus, roof conditions in these areas should be fair. Sections 2 and 4 have high roof stability factors, and, thus, the roof conditions in these sections should be good.

Although possible unstable mine opening areas were identified using the RSF as described above, other techniques may be utilized to identify potentially unstable mine opening areas. For instance, based on the results of the FEA model to determine the stress distribution in the surrounding strata, a Tensile Safety Factor (TSF) for all midpoint nodes of the immediate roof along the mine slope may be calculated. The TSF is defined as a ratio of the tensile strength of rock strata to the horizontal stress at a specified location. Typically, the TSF varies dramatically with change of depth of cover and rock lithology. In cases where laboratory rock testing results are not available, however, the TSF values derived from the computer model may not reflect actual conditions.

Figure 9:
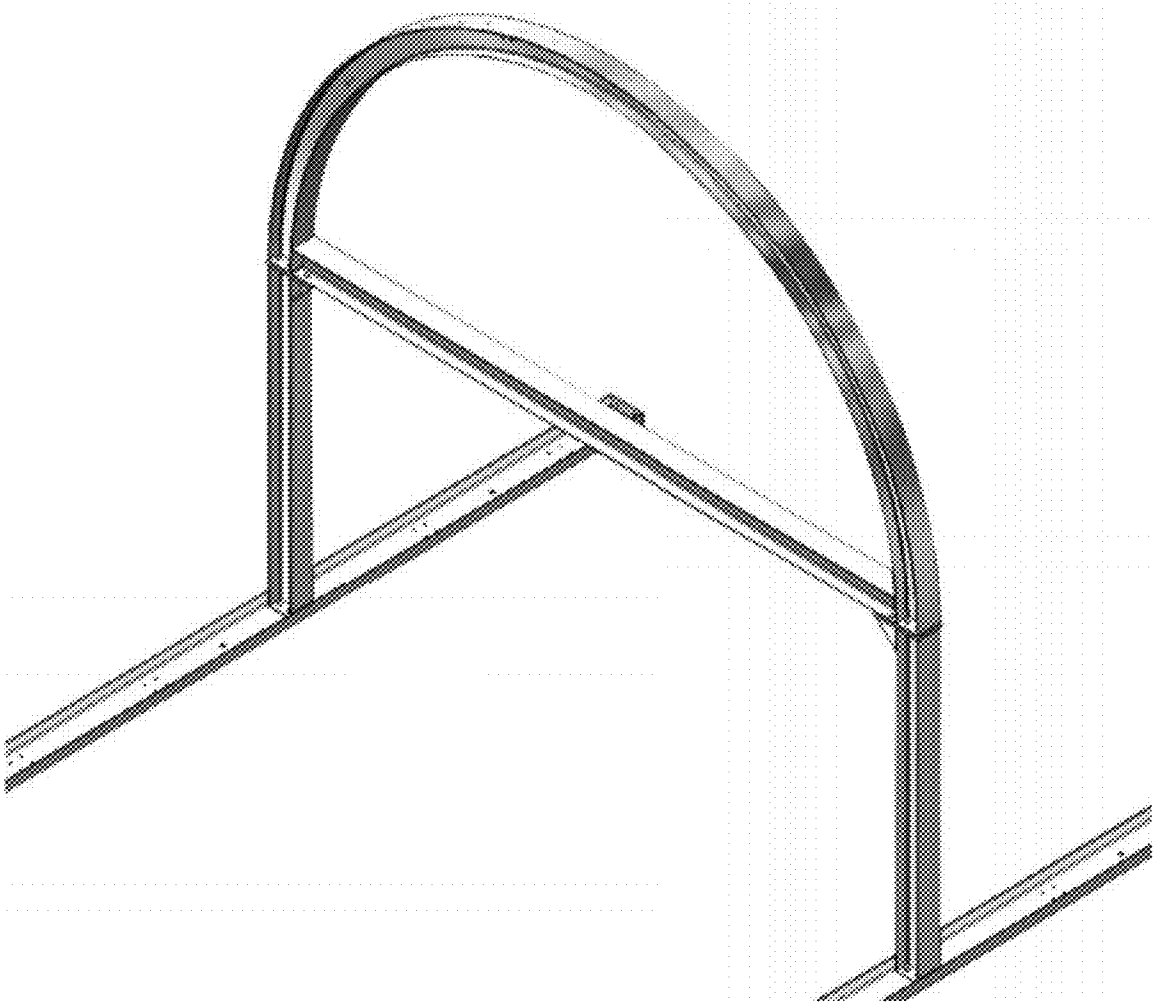
FIG. 9 is a perspective view of the designed 4-piece double compartment semi-circular arch set.
Figure 10A:
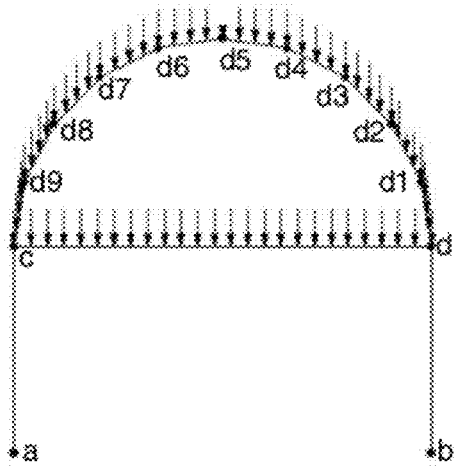
FIG. 10A shows a load diagram of the arch set shown in FIG. 9.
Figure 10B:
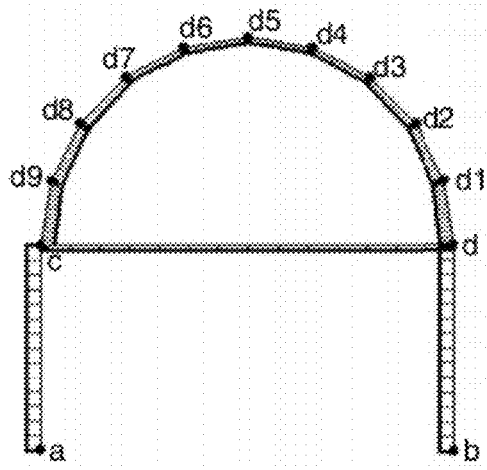
FIG. 10B shows an axial diagram of the arch set shown in FIG. 9.
Figure 10C:
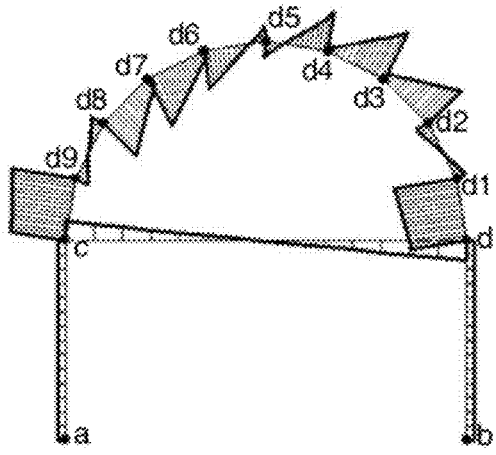
FIG. 10C shows a shear diagram of the arch set shown in FIG. 9.
Figure 10D:
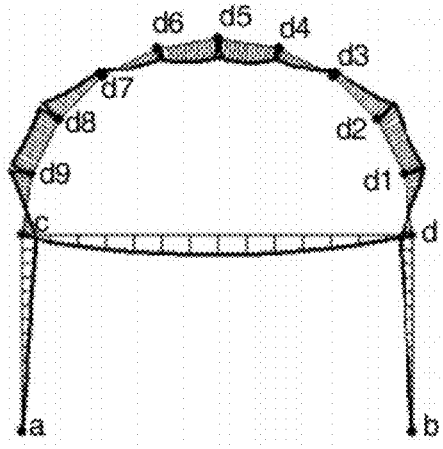
FIG. 10D shows a moment diagram of the arch set shown in FIG. 9.

Structural analysis indicates that a semi-circular W8×31 arch set can satisfy the design requirements to serve as long-term roof support. A three-dimensional drawing of the developed semi-circular, two-compartment arch set is shown in FIG. 9. Steel structure analysis indicates that, at 4 ft spacing, the arch set is capable of sustaining 78.6 tons of uniformly distributed load, or 18.2 ft high dead rock load. The load, axial, shear, and moment diagrams of the arch set are shown in FIGS. 10A-10D. The adequacy of the proposed arch set design is then verified using the AISC standards, assuming a uniform dead load of 4.37 tons per ft, which is equivalent to 18 ft×4 ft×18.2 ft rock load with a safety factor of 1.67. By following the industrial standard Allowable Stress Design (ASD) method suggested by the AISC, the W8×31 arch set can be verified to have adequate strength to the meet the design criterion based on the AISC standards.

Figure 11:
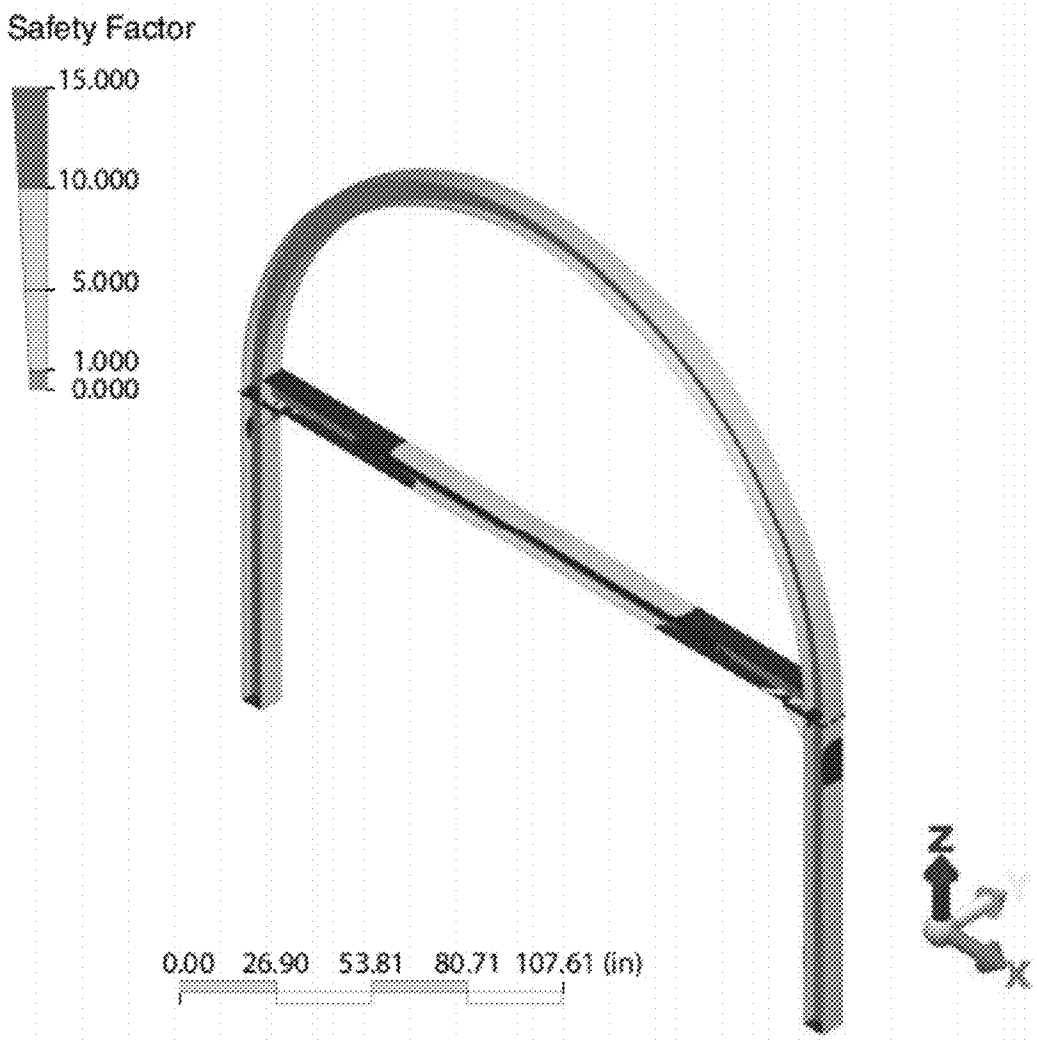
FIG. 11 is a perspective view of a finite element computer model of the arch set in FIG. 9, showing safety-factor values.

Further, the ability of the above designs to accept the expected rock dead load is verified by finite element analysis. A three-dimensional finite element computer model of the selected steel set is developed to validate the performance of the selected W8×31 arch set structure assuming a maximum of 4.37 tons per ft of uniform dead load applied on the cross member. In this example, the selected arch set was found to have a maximum vertical displacement of 0.385 occurring at the midpoint of the divider beam. Referring to FIG. 11, the distribution of the safety factor across the selected steel structure does not show an apparent stress concentration area at the connection between the arch and leg. The safety factors are calculated based on the maximum shear-stress theory of elastic failure. This theory defines the safety factor as the ratio of one-half the tensile yield strength of a material to the maximum shear stress. Generally, a safety factor of 1 to 3 is reasonable for material design. A safety factor of less than 1 indicates material failure can be expected in some areas of the structure. The distribution of the safety factor, shown in FIG. 11, indicates the arch does not have any apparent stress concentration and no material failure. Therefore, it is concluded that the designed arch set has the expected static support capacity.

EXAMPLE 2

In a further example, three proposed mine slopes extend a total length of approximately 600 ft at a grade of 7°. A cross-cut will be developed every 275 ft and the pillar width between adjacent slopes will be 70 ft. The middle slope has a slope opening that is 18 ft wide by 9 ft high. The outer slopes have a slope opening that is 18 ft wide by 8 ft high. The geological strata information was primarily obtained from an adjacent borehole as described above in connection with EXAMPLE 1.

The stress and geological conditions of the mine slopes was determined using FEA computer modeling programs based on the mine slope information. A three-dimensional linear model was established based on a slope dip of 7°. To minimize the number of elements, symmetrical models are used, including half-width of the middle slope (9 ft), 70 ft barrier pillar, 18 ft slope width, and 90 ft solid strata on one side of the slopes. A standard gravitational load was assigned on the model based on the generic material density of each stratum. In this particular example, no rock mechanics testing results were provided, so generic engineering properties of rock strata were utilized in the analysis.

Figure 12:
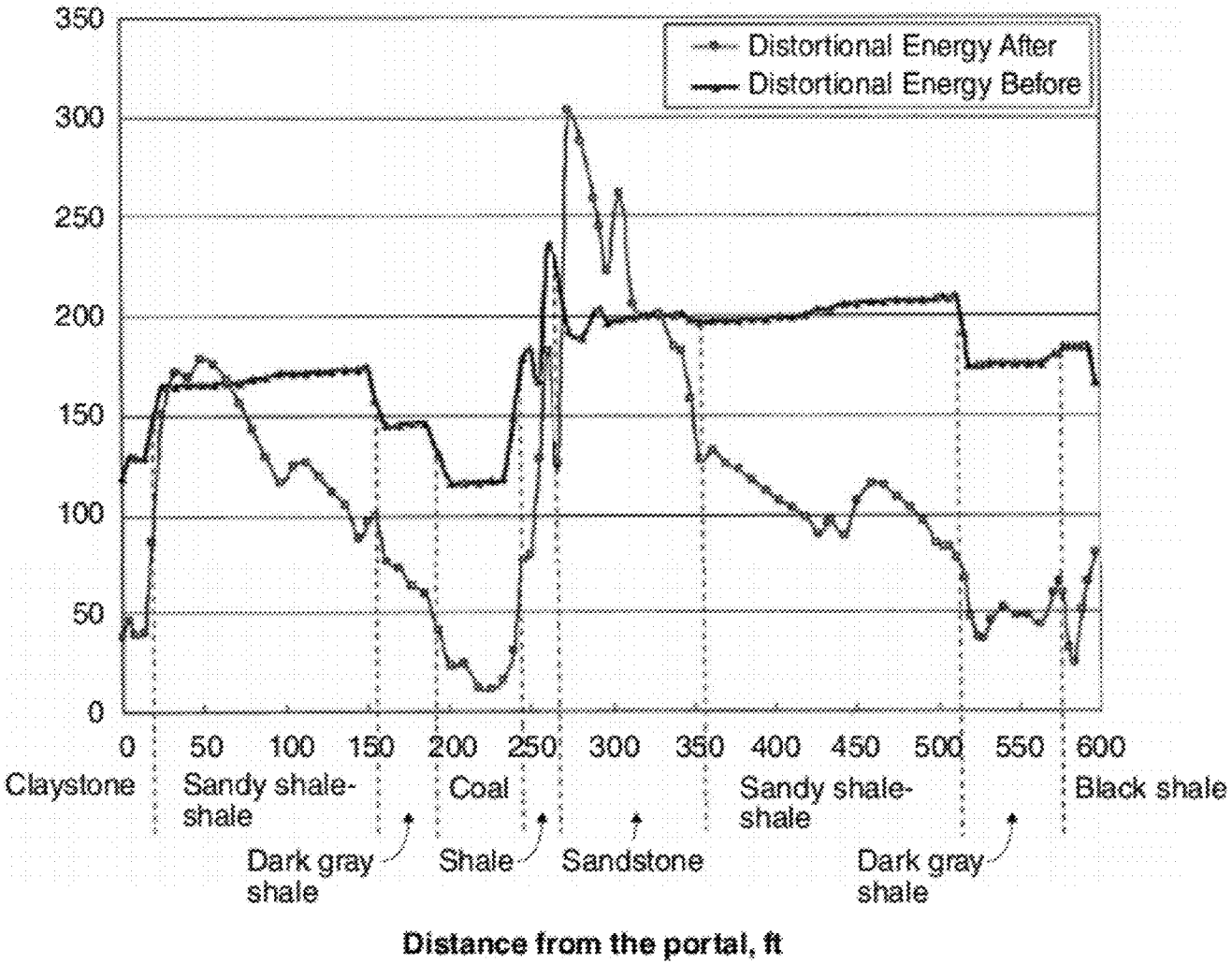
FIG. 12 is a graph of a distortional energy scalar distribution along the center line of slopes before and after excavation.

A distortional energy scalar distribution, shown in FIG. 12, along the center line of the slope roof before and after excavation was also determined from the model. The distortional energy scalar values are the combined effect of rock characteristics and overburden depth. Before excavation, sandstone, sandy shale, and shale incur generally larger shear stresses than adjacent strata. As the overburden depth increases, a same type of strata tends to incur larger shear stresses. After excavation, the sandstone stratum incurs a significant shear stress due to its stiff nature. In contrast, coal, claystone, dark gray shale, black shale, shale, and sandy shale incur less shear stress due to their less stiff characteristics.

Figure 13:
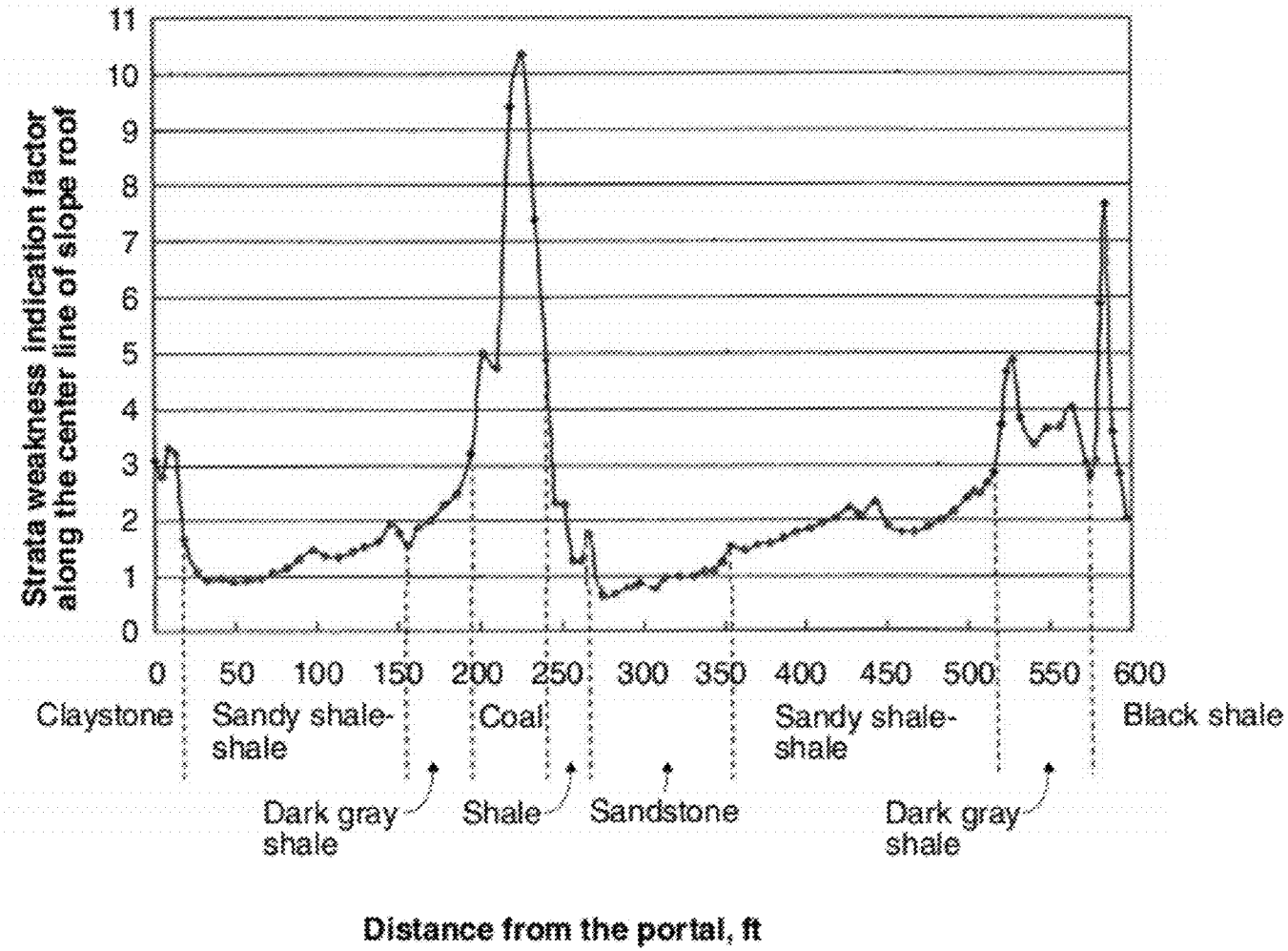
FIG. 13 is a graph of strata weakness indication factor values along the center line of slope roofs.

Based on the results from the finite element model of the mine slopes, a Strata Weakness Indication Factor (SWIF) is determined to identify the weak zones along the slopes. The SWIF is defined as the ratio of the in-situ original distortional energy scalar of rock before excavation to the same scalar after excavation under certain overburden and geological conditions. Because the sandstone will incur significant shear stresses and other strata will incur less stress, larger SWIF values indicate weaker rock. As shown in FIG. 13, the SWIF distribution along the center line of the slope roof indicates that the sections of sandstone and sandy shale/shale have a SWIF less than 2. The section of coal, claystone, dark gray shale, black shale, and shale have larger values, and can be identified as weak zones. Accordingly, the subsequent design of the supports for these sections of the mine slope may be modified to account for the possible weak zones along the slope.

The initial design for the structural supports for the mine slope was determined based on prior experience, expected support capacity and the AISC standards. The dead weight Q the steel set will support is defined as:

$$Q = \text{entry width} \times \text{set spacing} \times \text{caving height} \times \text{rock density}.$$

The required support capacity q in terms of uniform loading is defined as:

$$q = Q/L$$

where L is the cross-beam length of the steel set. Based on the required support capacity q, the required components of the steel set can be selected based on previous design experience as well as the standards of the AISC. Accordingly, in the present example, a W8×48 member was selected for the cross-beam and W8×31 members were selected for the legs of the steel set design. The adequacy of the initial steel set design was verified using the AISC standards. If the selected steel set design was found to not have adequate strength to meet the design criterion based on the AISC standards, the design process would start over. The moment connection and base plate design may also be selected as described hereinabove and verified according to AISC standards.

A three dimensional FEA computer model of the selected steel set was then developed to validate the performance of the selected steel set structure. The safety factor, stress, and deformation distributions of the steel set under a load were determined from the computer model. The mechanical properties of the steel used in the steel set were used in developing the computer model. Further, a uniform loading of 69,120 lbs was applied to the cross-beam. The safety factors are calculated based on the maximum shear-stress theory of elastic failure, as discussed hereinabove with respect to EXAMPLE 1. The results from the finite element computer model validate that the selected steel set design will meet the required capacity and design criterion.

As discussed hereinabove, the present invention may be used to accurately and safely design steel set as permanent supports for an underground mine opening in a cost efficient manner through the incorporation of geotechnical and stress information of the rock strata, FEA modeling, and proven steel structure design standards.

The methods and systems described herein may be deployed in part or in whole through a machine that executes computer software, program codes, and/or instructions on a processor. For example, the finite element analysis and computer modeling may be performed using commercially available finite element programs such as ANSYS, ABAQUS, NASTRAN, ALGOR, ADINA and other suitable programs. Other steps of the method, such as receiving mine opening information, designing the structural supports, and verifying the adequacy of the structural support design, may also be deployed through a machine that executes computer software. The processor may be part of a server, client, network infrastructure, mobile computing platform, stationary computing platform, or other computing platform. A processor may be any kind of computational or processing device capable of executing program instructions, codes, binary instructions and the like. The processor may be or include a signal processor, digital processor, embedded processor, microprocessor or any variant such as a co-processor (math co-processor, graphic co-processor, communication co-processor and the like) and the like that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program instructions and the like described herein may be implemented in one or more thread. The thread may spawn other threads that may have assigned priorities associated with them; the processor may execute these threads based on priority or any other order based on instructions provided in the program code. The processor may include memory that stores methods, codes, instructions and programs as described herein and elsewhere. The processor may access a storage medium through an interface that may store methods, codes, and instructions as described herein and elsewhere. The storage medium associated with the processor for storing methods, programs, codes, program instructions or other type of instructions capable of being executed by the computing or processing device may include but may not be limited to one or more of a CD-ROM, DVD, memory, hard disk, flash drive, RAM, ROM, cache and the like.

The methods and/or processes described above, and steps thereof, may be realized in hardware, software or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

The above invention has been described with reference to the preferred embodiments. Obvious modifications, combinations and alterations will occur to others upon reading the preceding detailed description. It is intended that the invention be constructed as including all such modifications, combinations and alterations insofar as they come within the scope of the following claims or the equivalents thereof.

The invention claimed is:

1. A method of designing supports for an underground mine opening comprising the steps of:

(a) receiving mine opening information including at least one of site location, entry length, entry grade, entry orientation, size of opening, surface topology, adjacent borehole data and rock mechanics test data, historical roof fall height, and expected steel set support capacity;

(b) conducting stress and geological condition evaluation of the mine opening using a finite element computer modeling program based on the mine opening information;

(c) designing structural supports for the mine opening utilizing the stress and geological condition evaluation of the mine opening;

(d) determining at least one of a Strata Weakness Indication Factor (SWIF), a Roof Stability Factor (RSF), and a Tensile Safety Factor (TSF), wherein the SWIF is defined as the ratio of in-situ original distortional energy scalar of rock before excavation to the distortional energy scalar after excavation under overburden and geological conditions, wherein the RSF is defined as the ratio of shear strength generated by normal confinement, cohesion, and angle of internal friction, to actual maximum shear stress at a mid-span of the mine opening immediate roof, and wherein the TSF is defined as a ratio of tensile strength of rock strata to horizontal stress at a specified location;

(e) identifying potentially weak zones of rock strata or potentially unstable section of the roof strata or potentially unstable sections of rock strata along the mine opening, wherein a comparatively larger SWIF indicates the potentially weak zone of the rock strata, wherein a comparatively lower RSF indicates the potentially unstable section of the roof strata, and wherein a comparatively lower TSF indicates the potentially unstable sections of the rock strata; and (f) modifying the design of the structural supports based on the potential weak zones of the rock strata or potentially unstable section of the roof strata or potentially unstable sections of the rock strata.

2. The method of claim 1, further comprising the step of:

verifying the adequacy of the structural support design following American Institute of Steel Construction (AISC) national standards.

3. The method of claim 2, further comprising the step of:

validating the structural support design using a finite element computer modeling program.

4. The method of claim 1, further comprising the step of:

validating the structural support design using a finite element computer modeling program.

5. The method of claim 1, wherein the designing of the structural supports for the mine opening further utilizes at least one of primary roof bolting plan, current industrial practice, expected support capacity, size of the opening, and AISC national standards.

6. A system for designing supports for an underground mine opening, the system comprising a computer having a computer readable medium having stored thereon instructions which, when executed by a processor of the computer, causes the processor to perform the steps of:

(a) receiving mine opening information including at least one of site location, entry length, entry grade, entry orientation, size of opening, surface topology, adjacent borehole data and rock mechanics test data, historical roof fall height, and expected steel set support capacity;

(b) conducting stress and geological condition evaluation of the mine opening using a finite element computer modeling program based on the mine opening information;

(c) selecting a structural support design for the mine opening utilizing the stress and geological condition evaluation of the mine opening and known support capacity of structural support designs;

(d) determining at least one of a Strata Weakness Indication Factor (SWIF), a Roof Stability Factor (RSF), and a Tensile Safety Factor (TSF), wherein the SWIF is defined as the ratio of in-situ original distortional energy scalar of rock before excavation to the distortional energy scalar after excavation under overburden and geological conditions, wherein the RSF is defined as the ratio of shear strength generated by normal confinement, cohesion, and angle of internal friction, to actual maximum shear stress at a mid-span of the mine opening immediate roof, and wherein the TSF is defined as a ratio of tensile strength of rock strata to horizontal stress at a specified location;

(e) identifying potentially weak zones of rock strata or potentially unstable section of the roof strata or potentially unstable sections of rock strata along the mine opening, wherein a comparatively larger SWIF indicates the potentially weak zone of the rock strata, wherein a comparatively lower RSF indicates the potentially unstable section of the roof strata, and wherein a comparatively lower TSF indicates the potentially unstable sections of the rock strata; and (f) modifying the design of the structural supports based on the potential weak zones of the rock strata or potentially unstable section of the roof strata or potentially unstable sections of the rock strata.

7. The system of claim 6, wherein instructions further cause the processor to perform the step of:

verifying the adequacy of the structural support design following AISC national standards.

8. The system of claim 6, wherein instructions further cause the processor to perform the step of:

validating the structural support design using a finite element computer modeling program.

* * * * *